US006942364B1

(12) United States Patent
Wegner et al.

(10) Patent No.: US 6,942,364 B1
(45) Date of Patent: Sep. 13, 2005

(54) LUMINAIRES HAVING APERTURE-MODIFYING STRUCTURES FOR PRODUCING VISUALLY SMOOTH LIGHT DISTRIBUTIONS

(75) Inventors: Scott D. Wegner, Conyers, GA (US); Carl T. Gould, Decatur, GA (US)

(73) Assignee: Acuity Brands, Inc., Atlanta, GA (US)

( * ) Notice: Subject to any disclaimer, the term of this patent is extended or adjusted under 35 U.S.C. 154(b) by 11 days.

(21) Appl. No.: 10/428,902

(22) Filed: May 2, 2003

(51) Int. Cl.[7] ..... F21S 8/00
(52) U.S. Cl. ..... 362/281; 362/147; 362/217
(58) Field of Search ..... 362/147, 217, 362/296, 260, 347, 281, 283

(56) References Cited

U.S. PATENT DOCUMENTS 4,564,888 A * 1/1986 Lewin et al. ..... 362/147
4,872,098 A * 10/1989 Romano ..... 362/283
5,142,459 A * 8/1992 Swarens et al. ..... 362/217
5,535,110 A * 7/1996 Ling ..... 362/297
5,800,050 A * 9/1998 Leadford ..... 362/296
6,342,695 B1 * 1/2002 Ramer et al. ..... 250/214 R
6,350,047 B1 * 2/2002 Ng et al. ..... 362/364
6,382,817 B1 * 5/2002 Chelf ..... 362/322
6,561,670 B1 * 5/2003 Jongewaard et al. ..... 362/147

* cited by examiner

*Primary Examiner*—Ali Alavi
(74) *Attorney, Agent, or Firm*—Kenneth E. Darnell

(57) ABSTRACT

Luminaires particularly useful for ceiling mounting in either recessed or surface-mounted applications and intended for "washing" light over an adjacent wall, the "wall wash" luminaires of the invention are configured in preferred embodiments for operation with elongated lamping and particularly tubular fluorescent lamping including T5 lamps. The present luminaires are usually provided with elongated and other apertures, certain of which are often referred to as "small" apertures, conformed by shaping of at least one elongated edge thereof to minimize alternating relatively light and dark striations on adjacent walls. Luminaires according to the invention having relatively narrow elongated apertures function to transition abrupt changes in luminance imaged onto an adjacent wall by alteration of aperture opening, such as by an extension of structure from one elongated edge of such an aperture, thereby to produce a more smooth vertical light distribution over the wall.

54 Claims, 4 Drawing Sheets

LUMINAIRES HAVING APERTURE-MODIFYING STRUCTURES FOR PRODUCING VISUALLY SMOOTH LIGHT DISTRIBUTIONS

BACKGROUND OF THE INVENTION

1. Field of the Invention

The invention generally relates to luminaires and particularly to luminaires intended for ceiling mounting in either recessed or surface-mounted applications for "washing" an adjacent wall with light as well as other applications.

2. Description of the Prior Art

Luminaires intended for directing light onto vertical surfaces such as walls often fail to provide a visually smooth distribution of light on the vertical surface intended to be illuminated. Such luminaires, generally referred to as "wall wash" luminaires, are typically mounted in a ceiling in proximity to the vertical surface that is to be illuminated. In providing the goal of a smooth distribution of light on a vertical surface of an adjacent wall, it is intended that visible striations or noticeably defined changes in brightness on the vertical surface be minimized or eliminated. Since the accomplishment of a smooth illumination gradient on such a vertical surface is a goal rather than a realistic expectation, it is at least intended in the art to provide an illuminance on said surface having gradations that are sufficiently gradual so as to reduce the affects of variations in brightness such as can take the form of bright or dark lines, bands, scallops and the like such as can be visually distracting. Wall wash luminaires universally employ reflective surfaces configured not only to direct light from lamping onto an adjacent vertical surface but also to smooth the light pattern on said surface. A judicious choice of reflective material as is usual in the prior art, typically diffuse or semi-specular in nature, has previously been considered desirable for smoothing of a light pattern on a vertical surface albeit at the cost of efficiency loss when considering the lumens delivered to the vertical surface by lamping of a particular power level. Diffuser lenses have also been used for similar purposes and with similar results including losses. Luminaires configured with "small apertures", that is, small in the dimension perpendicular to the "longitudinal" dimension of the luminaire, particularly suffer from efficiency losses when reflectors employed in such luminaires are formed of diffuse or semi-specular reflective material. Luminaires with square apertures as well as other shapes can also exhibit such losses. Further, the differences in brightness between the lamping as compared to lamp "images" in the reflected material produce further difficulties in providing the quality of illumination on a vertical surface that is desired in the art when light from the lamp and from the reflector are both incident on the wall. The use of highly reflective and highly specular reflective material in such luminaires increases the efficiency of light directed onto the vertical surface, and thereby illumination levels realized on the vertical surface, and also greatly reduces differences between the brightness of light illuminating the wall directly from lamping as opposed to the brightness of light reflected from reflectors used in such luminaires. However, utilization of highly specular reflective material in such luminaires provides no panacea in intended results due to the fact that the behavior of highly specular materials in optical environments are extremely sensitive to design errors as well as manufacturing and assembly tolerances. Accordingly, the use of highly specular reflective materials as reflectors in small aperture luminaires as well as other luminaires does not necessarily produce the desired visual appearance of illumination washing a vertical surface or wall.

Wall wash luminaires mountable in ceilings of varying description have previously been provided in a multitude of configurations including downlighting luminaires having circular apertures such as are disclosed by Ling in U.S. Pat. No. 5,535,110 and Leadford in U.S. Pat. No. 5,800,050. Ng et al, in U.S. Pat. No. 6,350,047, and many others, also provide wall wash luminaires intended to be mounted in recessed applications in ceilings whereby at least a portion of that light generated within the luminaire is directed onto at least portions of a wall adjacent to the location wherein the luminaire is mounted within a ceiling. In luminaires of the kind just noted, lamping typically mounted in a vertical orientation is utilized and is generally not tubular fluorescent lighting of a length generally greater than approximately six to ten inches. Wall Wash luminaires employing elongated tubular fluorescent lamping such as T12, T8 and even T5 lamping presently exist as can be appreciated by reference to U.S. Pat. No. 4,564,888 to Lewin et al which discloses a substantially elongated luminaire configured with an elongated reflector for directing light onto a wall from a substantially elongated and generally rectangular aperture. Crane, in U.S. Pat. No. 5,146,393 also discloses a luminaire intended to wash an adjacent wall with light from a location recessed within a ceiling adjacent to the wall. While the apertures of the Lewin et al and Crane luminaires are not necessarily of the "small aperture" kind, the apertures of the luminaires disclosed in these two patents are rectangular and utilize elongated fluorescent lamping. While lamping-such as T5 lamping can be used in prior wall wash luminaires and even in the rectangular aperture luminaires disclosed in certain of the above-noted patents, it is to be understood that presently available wall wash luminaires have not exhibited performances approaching the goal of a visually smooth distribution of light on a vertical surface in linear wall wash configurations in luminaires using highly specular materials unless provided with a lens. It is therefore a particular intent of the present luminaire configurations to produce an acceptably smooth distribution of light on a vertical surface from a wall wash luminaire, particularly a small aperture luminaire, as can be mounted in recessed or surface-mounted applications in a ceiling at a distance from the vertical surface to be illuminated such that the cross-sectional aperture of the luminaire is small relative to the distance of the luminaire from a vertical surface that is to be illuminated. Luminaires configured according to the invention are configured to utilize highly reflective and highly specular reflective materials as reflector elements and are further configured to provide visually smooth lighting distributions on adjacent vertical surfaces such that striations and/or alternating relatively light and dark areas are reduced or visually eliminated, thereby providing a substantial advance in the art.

SUMMARY OF THE INVENTION

The invention provides in several embodiments luminaires adapted for efficient utilization of linear illumination sources such as tubular fluorescent lamps of differing type and dimension. The invention particularly intends improvement of luminaires of a kind typically referred to as "small aperture" luminaires including such luminaires intended for the "washing" of a wall or vertical surface with light generated from a location on or near a ceiling, such location being essentially adjacent to a vertical surface which is to be washed with light. The luminaires of the invention, including those luminaires often referred to as small aperture luminaires, are typically mounted in a recessed mode in a ceiling or surface-mounted to a ceiling, such ceilings typically being suspended or conventional drywall, plaster or the like. The luminaires of the invention are intended to provide a visually smooth distribution of light on a surface, particularly a vertical surface such as an adjacent wall when such luminaires are ceiling mounted. The invention further contemplates luminaires other than ceiling-mounted wall wash luminaires such as luminaires intended to direct light onto horizontal surfaces including pathways and the like. In such situations, luminaires such as bollards intended to illuminate areas adjacent such bollards can be configured to direct a smooth light distribution onto surfaces used by pedestrians as one example. The invention therefore finds utility in the general field of area lighting, pathway lighting, wall sconce uplighting, etc.

The invention finds particular utility in wall wash and other applications wherein linear illumination sources such as elongated tubular fluorescent lamps are employed, the invention being useful with illumination sources including T5 lamping. In luminaires configured according to the invention which utilize such lamping, the invention applies in certain embodiments to a luminaire genre such as is commonly referred to as a "small aperture" luminaire. A small aperture luminaire commonly employs elongated tubular fluorescent lamping, the aperture of such a luminaire being essentially as long as the lamping that is employed. As such, the apertures of small aperture luminaire is essentially elongated and of a length substantially equal to the length of the lamp or lamps employed for generation of light. It is therefore seen that such an aperture would typically be configured essentially as a rectangle although other shapes could be employed. In wall washing applications in particular, the essentially rectangular aperture of a luminaire configured according to the invention would have one elongated edge disposed substantially parallel to an adjacent wall which is to be washed with light, the small aperture luminaire being disposed in a ceiling adjacent to the wall or other vertical surface. The luminaire so located is provided with a reflector assembly configured to direct light reflected from lamping over at least portions of the adjacent wall, the reflector portions of the present reflector assembly being preferably formed of highly specular material with the result that lamp light imaged by the reflector assembly is effectively as bright as light from the lamp itself. In order to produce a visually smooth distribution of light on the adjacent wall, that is, a washing of the wall with light without striations or alternating relatively bright and relatively dark horizontally oriented areas, it is necessary according to the invention to configure the elongated edge of the aperture nearmost the adjacent wall in a manner to alter the vertical distance over which light from linear elements of the lamp and reflected lamp images are revealed in order to produce a smooth luminous gradient and to spread out illuminance changes over a relatively large angular zone or vertical distance on the lighted surface. The invention in several embodiments particularly contemplates the provision of structure on the "adjacent" elongated aperture edge that alters aperture geometry to cause a softening of what might otherwise be abrupt illuminance changes imaged onto the wall, thereby producing a smoother vertical distribution of light over the wall. Alteration of aperture geometry can be provided by the forming of the aforesaid adjacent aperture edge in the shape of a wedge in a preferred embodiment, thereby providing an "intrusion" into the aperture. Alternatively, the wedge shape of the adjacent aperture edge can be reversed or inverted to produce a desired result. For similar reasons, such intrusions can be configured by conforming the adjacent aperture edge to have a sawtooth edge, a sinusoidal edge, a gently rounded edge or the like over at least portions of said adjacent aperture edge, it being of greater moment to provide such an intrusion essentially at and/or near the center of said adjacent aperture edge. Apertures so configured according to the invention function particularly well with a reflector assemblies formed of highly specular material, it being possible through practice of the invention to utilize highly specular material in the formation of reflective surfaces without the concerns evident in the prior art which arise as a result of design and manufacturing errors including tolerances that cannot be controlled to a desirable degree in manufacturing and assembly processes. Luminaires configured according to the invention particularly provide wall or area washing capability with a desired visually smooth distribution of light on surfaces that are to be washed with light.

Accordingly, it is a primary object of the invention to provide luminaires capable of providing smooth light distributions on adjacent surfaces, such as ceiling-mounted luminaires capable of washing adjacent vertical surfaces with light, and wherein such luminaires are particularly intended to use elongated fluorescent lamping for generation of light thrown onto a surface through an elongated aperture having that lengthwise edge adjacent to the surface to be washed with light configured so as to increase the angular zone over which light from the lamping and light reflected from within the luminaire is revealed, thereby to produce a transition and spread what would otherwise be abrupt changes in luminance over a larger angular zone to reduce or effectively eliminate striations and the like in a pattern of light produced on the surface to be illuminated.

It is another object of the invention to provide luminaires such as are commonly referred to as "small aperture" luminaires wherein an elongated edge of such a luminaire is configured to be other than completely linear so as to produce a striation-free and relatively smooth distribution of light on an adjacent surface.

It is a further object of the invention to provide luminaires such as are commonly referred to as "small aperture" luminaires and which are intended for illuminating areas adjacent to said luminaires with a generally smooth distribution of light and wherein an elongated edge of such an aperture and adjacent to the area to be illuminated is caused to have at least portions thereof "intrude" into the aperture or alter the shape of the aperture in order to blend illuminance changes that are imaged onto the area and thereby provide a desired light distribution.

Further objects and advantages of the invention will become more readily apparent in light of the following detailed description of the preferred embodiments.

DESCRIPTION OF THE PREFERRED EMBODIMENTS

Figure 1:
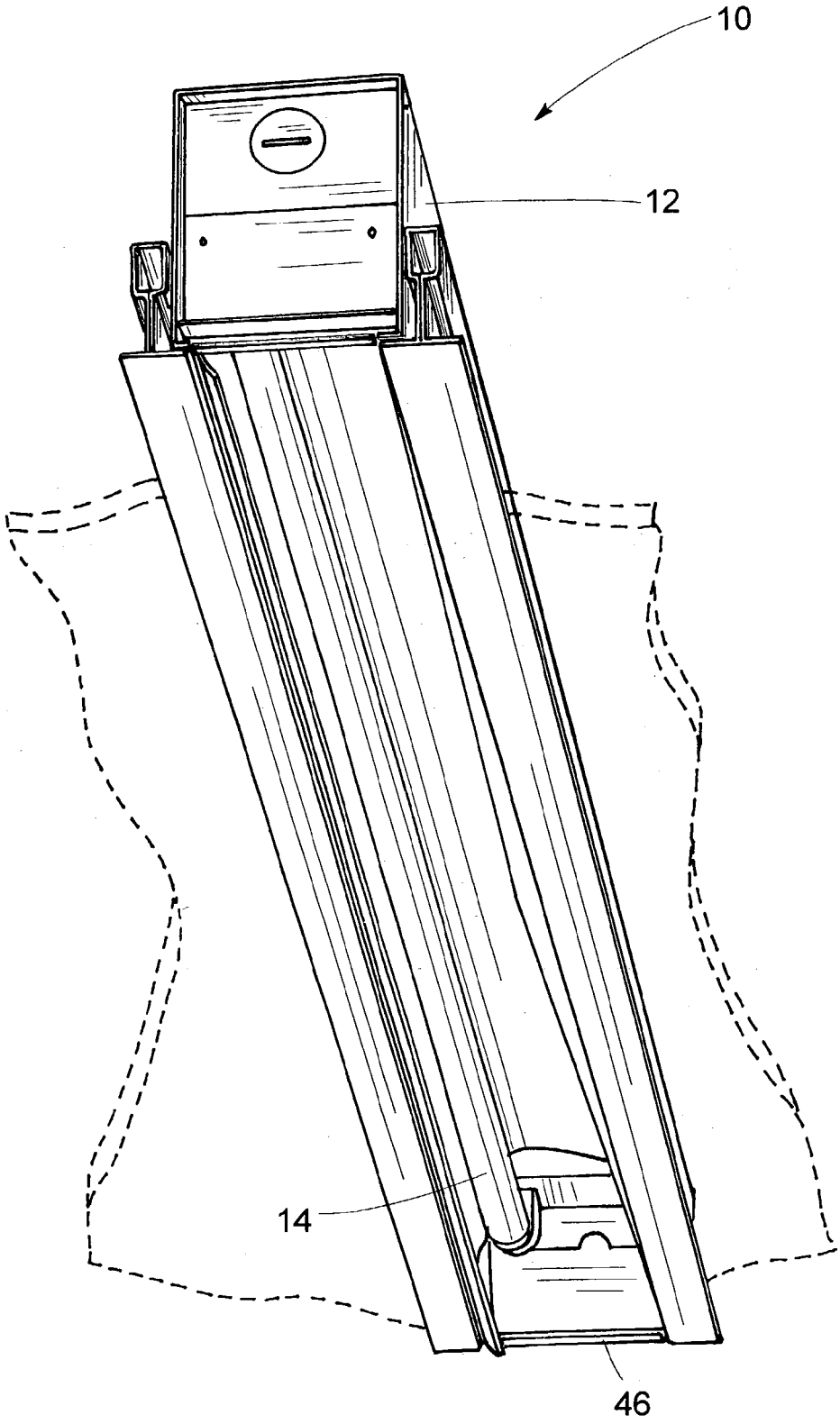
FIG. 1 is a perspective view of a luminaire configured according to the invention and shown mounted in a recessed application in a ceiling seen in phantom only.

Referring now to the drawings and particularly to FIGS. 1 through 4, a luminaire configured according to a preferred embodiment of the invention is seen at 10 to comprise a housing 12 of substantially rectangular configuration, the housing 12 being formed of sheet metal or the like such as is conventional in the art. The housing 12 has a lamp 14 mounted therein in a conventional manner in juxtaposition to a reflector assembly 16 having upper and lower reflectors 18 and 20 mounted together by means of a hinge 22. It is to be understood that the reflectors 18 and 20 can be formed as a single reflector. The housing 12 is seen to contain a ballast 24 within a compartment thereof formed generally by upper portions of the housing 12 above the upper reflector 18. The reflector assembly 16 is hinged by means of the hinge 22 to facilitate access to the ballast 24 and other structure associated with said ballast. The hinge 22 further permits adjustment of the relative positions of the upper reflector 18 and of the lower reflector 20 in order to provide the ability to alter the distribution of light on an adjacent wall (not shown) which is to be washed with light generated by the lamp 14. The reflective surfaces of the reflectors 18 and 20 can be shaped in the configuration of a parabola or in any other desirable configuration.

Figure 3:
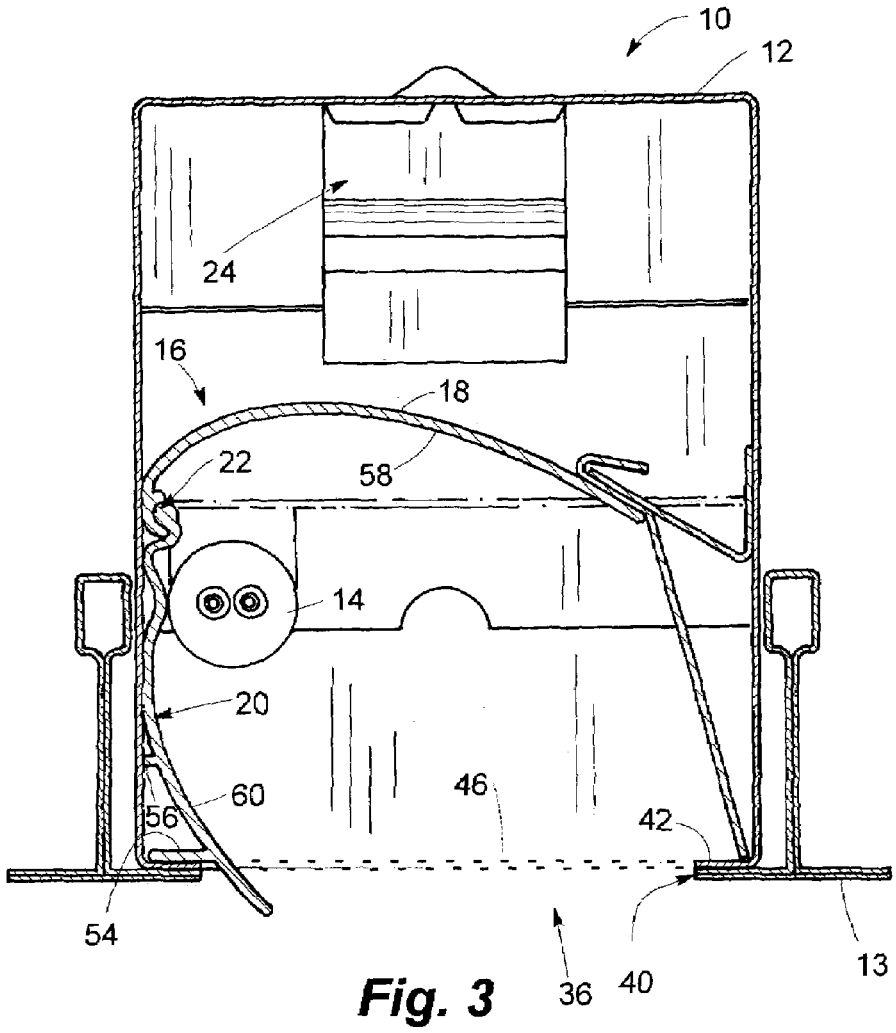
FIG. 3 is a cross-sectional view of the luminaire of FIG. 1.

The luminaire 12 as particularly seen in FIG. 1 is mounted in a recessed location within a ceiling 11 shown in phantom and is positioned in adjacent relation to a wall (not shown) which is to be washed with light as is known in the art. The luminaire 10 may be mounted within suspended ceilings or other ceiling structures such as can be formed with plasterboard and the like. As is seen in FIG. 3, the luminaire 10 is mounted in a suspended ceiling 13 as will be readily understood by those of skill in the art. It is to be understood that surface-mounted and pendant-mounted luminaires can also be configured according to the teachings of the invention.

The lamp 14 is mounted within the housing 12 in a conventional manner by means of sockets 26, the sockets 26 being mounted to brackets 28 disposed at either end of the housing 12, the housing 12 being essentially finished by the mounting of end plates 30 at each end thereof. Access to the interior of the housing 12 from a location at the top of the luminaire 10 is provided in a conventional manner by means of an access plate 32, the access plate 32 having knockouts 34 to permit electrical wiring (not shown) to extend from a power source (not shown) into the interior of the housing 12 as is conventional in the art.

The luminaire 10 has an aperture 36 formed essentially over a lower face of the housing 12, the aperture 36 being that "open" portion of the housing 12 through which light passes directly from the lamp 14 from the luminaire 10 and through which light reflected from the reflector assembly 16 inter alia passes to wash an adjacent wall (not shown), the direction of the wall as seen in FIG. 3 being shown by the arrow 38. The aperture 36 is defined by a forward edge 40 which essentially comprises an edge of a flange 42 which extends along a longitudinally disposed edge of the housing 12 essentially parallel to a wall that is to be washed with light. The forward edge 40 is essentially parallel to the lamp 14, the lamp 14 preferably being an elongated fluorescent lamp which can take the form of conventional lamping such as T12, T8, T5 or similar lamping. Other lamping, particularly lamping of elongated configuration, can be utilized to advantage according to the teachings of the present invention.

An opposite longitudinal edge of the aperture 36 is defined by the terminus 44 of the lower reflector 20, which terminus 44 can be configured to extend outwardly of the housing 12 as is best seen in FIG. 3. The aperture 36 is further defined by oppositely disposed side edges 46 which are edges of the respective end plates 30. In FIG. 3, one of the edges 46 is shown by way of a dotted line in order to facilitate a more understandable illustration of the invention.

Figure 4:
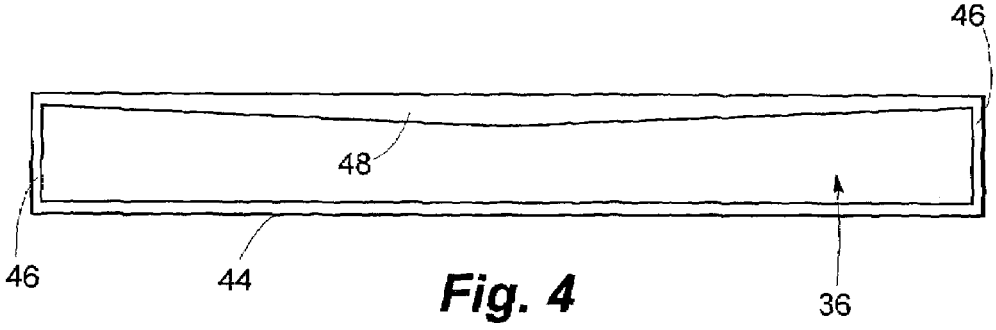
FIG. 4 is a diagrammatical view illustrating the shape of the aperture of the luminaire of FIG. 1.

Considering FIG. 4 in addition to FIGS. 1 and 3, it can be seen that the aperture 36 is substantially rectangular in conformation, the side edges 46 and that longitudinal edge provided by the terminus 44 of the lower reflector 20 defining three sides of a rectangular opening that is the aperture 36. As can be seen in FIG. 1 but best illustrated in FIG. 4, the forward edge 40 defining the remaining longitudinally-oriented side of the aperture 36 is seen to be formed in the shape of a wedge 48 which tapers from the side edges 46 to a maximum extent into the aperture 36 substantially centrally of the forward edge 40. It is to be understood that FIG. 4 is not shown to scale, the length of the aperture 36 being reduced by approximately one-half in relation to the length of the side edges 46 in order to emphasize the shape of the wedge 48. In essence, the wedge 48 acts as a desirable "intrusion" into the aperture 36 and thereby shapes the aperture 36 in order to cause light directed onto an adjacent wall to be smoothly distributed and without "striations" or alternating relatively light and dark lines as is common with conventional wall wash luminaires. It is therefore a primary teaching of the invention to provide structure along a forward edge of an aperture of any one of the luminaires disclosed herein so that changes in luminance from tamping such as the lamp 14 inter alia are delayed to thereby produce a smooth distribution over a surface that is to be washed with light. Essentially, the intrusion provided by the wedge 48 into the aperture 36 as seen in FIGS. 1 through 4 acts to increase the angular zone over which light from the lamp 14 and light imaged by the reflector assembly 16 are revealed to the wall, thereby to produce a transition and to blend out otherwise abrupt changes of luminance over a larger angular zone than would occur in the event that the forward edge 40 simply comprised a straight line edge as is conventional in the art. It is to be understood that variations in luminance can occur for a variety of reasons, among these reasons being differences in glass wall thicknesses of tamping such as the lamp 14. Further, light reflected from a reflector, such as the reflector assembly 16 within luminaires such as are considered herein can be substantially less luminous than that light emanating directly from lamping such as the lamp 14 and passing directly through an aperture of conventional configuration. When highly specular material is used to form reflective surfaces within a luminaire of the kind referred to herein, it is even possible that reflected images can be of greater luminosity due to re-radiation of lighting flux. In such situations, design and manufacturing errors due to tolerances and the like can provide additional difficulties in controlling light directed onto a wall or other surface with desirably smooth distributions. It is to be appreciated that striations and the like are caused in applications referred to herein by the use of highly specular material in reflector formation. Abrupt changes in luminance are commonly encountered with linear sources of light and linear reflectors as are commonly used in luminaires of the kind considered herein, the sensitivity of lighting distribution to such abrupt changes in luminance occurring both from light emanating directly from the lamp and passing through an aperture and from lamp image reflected from a reflector within such a luminaire. As can thus be understood, any sudden gradation or sudden changes in the rate of gradation of light within such an aperture whether brighter or darker results in corresponding bright and dark stripes on a wall or other surface that is to be washed with light from such luminaires, these stripes being typically referred to as "striations" as referred to above. In such situations, an aperture opening formed solely of straight lines is susceptible to a less than smooth light distribution since these abrupt changes of luminance appear along the entire length of an aperture so configured at exactly the same vertical position on the lighted surface. The provision of the wedge 48 in the aperture 36 as described above results in a smoother distribution over a surface that is to be illuminated.

Figure 2:
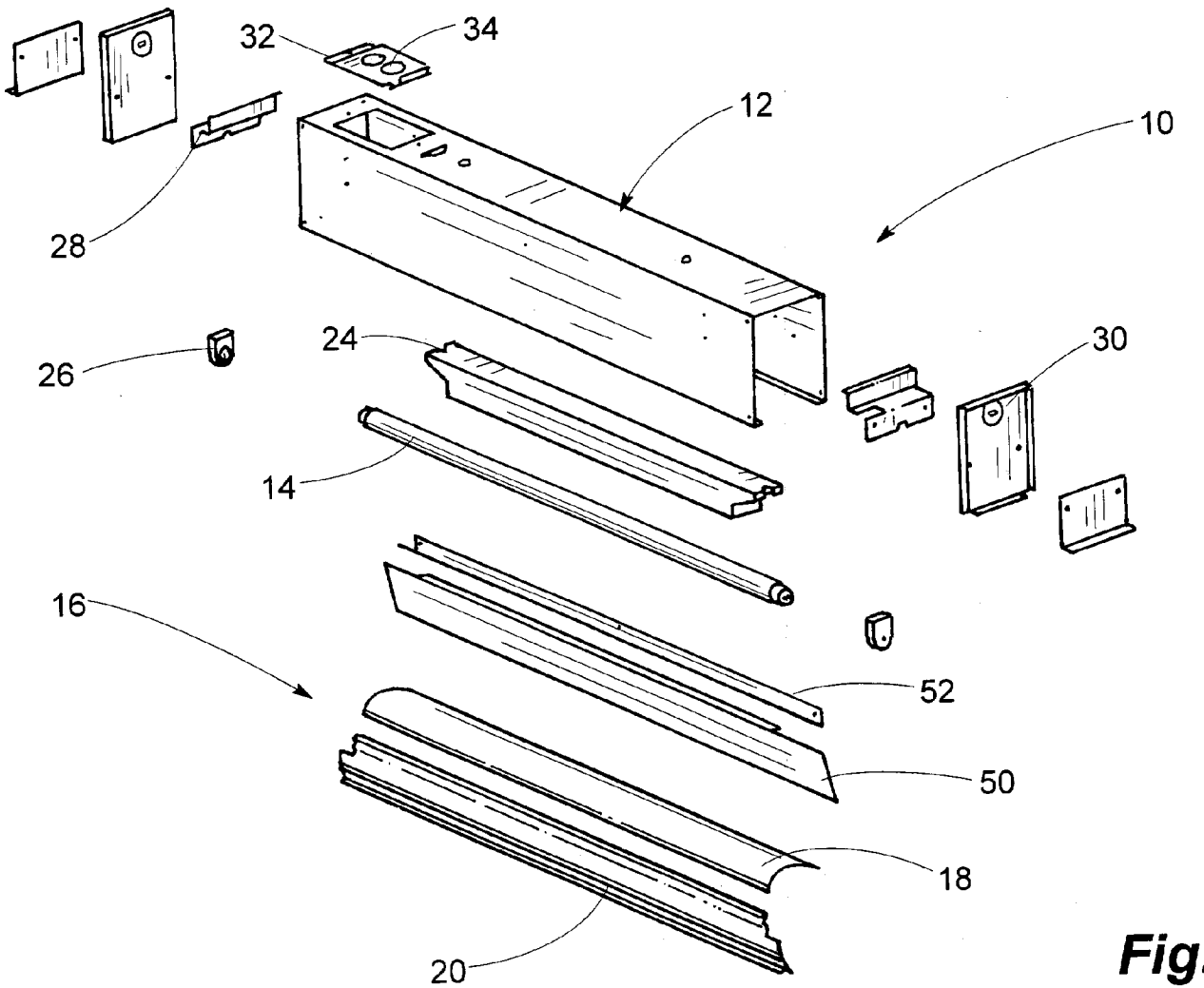
FIG. 2 is an exploded view of the luminaire of FIG. 1.

Referring further to FIGS. 1 through 3 in particular, a trim 50 can be disposed interiorly of the housing 12 and mounted by brackets 52 for decorative purposes and also for maintaining light generated by the lamp 14 within an optical chamber defined within the luminaire 10 in association with the reflector assembly 16. That portion of the lower reflector 20 extending outwardly of the housing 12 as noted hereinabove acts to ensure appropriate direction of light onto a surface that is to be illuminated. The lower reflector 20 can be mounted within the housing 12 by means of integral flanges 54 and 56 as is conventional in the art. The reflectors 18 and 20 are preferably formed with highly specular reflective surfaces 58 and 60 respectively, the reflectors 18 and 20 preferably being aluminum extrusions with vacuum metallized finishes comprising the surfaces 58, 60, the surfaces 58 and 60 being of high specularity and high reflectance. It is to be understood that the luminaires disclosed herein are less susceptible to design and manufacturing errors such as are commonly encountered in the use of highly specular material as reflective surfaces and wherein lens structures are not provided to cover apertures. Prior luminaires of the kind referred to herein typically suffer from reduced lighting efficiency by virtue of the need to utilize diffuse or semi-specular reflective surfaces in reflector structure corresponding to the reflectors 18, 20 as described herein. Configuration of apertures as described herein therefore permits use of highly specular material as surfaces for reflector structure without the difficulties inherent in the prior art, thereby permitting light generated by lamping to be more efficiently utilized.

Referring again to FIG. 4, it is to be seen that an aperture such as the aperture 36 shown therein would typically have dimensions of approximately three inches along the side edges 46 and would be approximately forty-eight inches in lengthwise dimensions. It is to be appreciated that the dimensions of an aperture so configured can differ from those indicated with, for example, lengthwise dimensions being on the order of twenty-four inches with side edges such as the side edges 46 being three inches. Such dimensions accommodate commonly available lengths of tubular fluorescent lamping whether that lamping comprises single lamping or multiple lamps in an array with longitudinal axes being linearly arranged.

Figure 5:
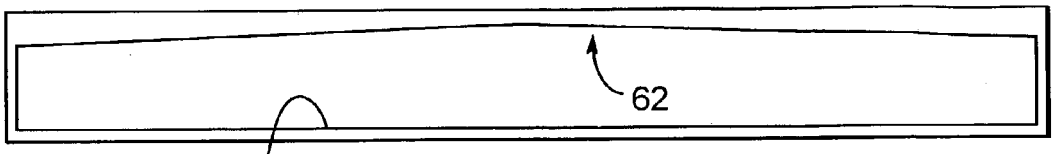
FIG. 5 is a diagrammatical view of another embodiment of an aperture configured according to the invention.

Further embodiments of the invention are provided respectively in FIGS. 5 through 10 as being exemplary of suitable configurations of apertures that can provide the functions and advantages noted herein. Referring first to FIG. 5, it can be seen that a forward edge 62 of an aperture 64 can be formed essentially as the inverse of the wedge 48 of the aperture 36. The configuration of FIG. 5 to produce the optical transition referred to hereinabove and therefore is intended to fall within the definition of the term "intrusion" as used herein since the edge 62 "intrudes" on side portions of the aperture 64.

Figure 6:
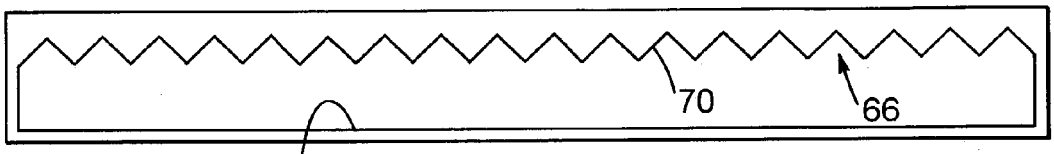
FIG. 6 is a diagrammatical view of yet another embodiment of an aperture configured according to the invention.

Referring now to FIG. 6, a forward edge 66 of an aperture 68 configured according to a further embodiment of the invention is seen to take the form of a plurality of teeth 70, such as in a sawtooth pattern, with the teeth 70 providing intrusions into the aperture 68 to provide the performance intended according to the invention. The teeth 70 can take the form of triangles of differing type and dimensions.

Figure 7:
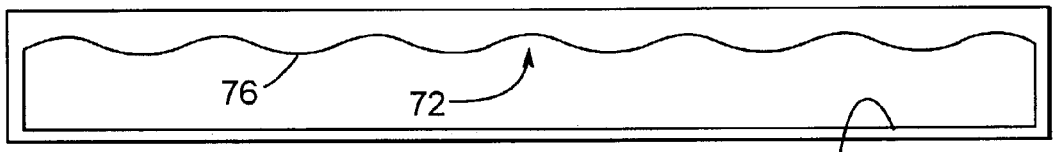
FIG. 7 is a diagrammatical view of a further embodiment of an aperture configured according to the invention.

Referring now to FIG. 7, a forward edge 72 of an aperture 74 is seen to be formed as a substantially sinusoidal curve 76 with portions of the curve 76 acting as intrusions into the aperture 74. It is to be understood that the curve 76 could take other than a sinusoidal form.

Figure 8:
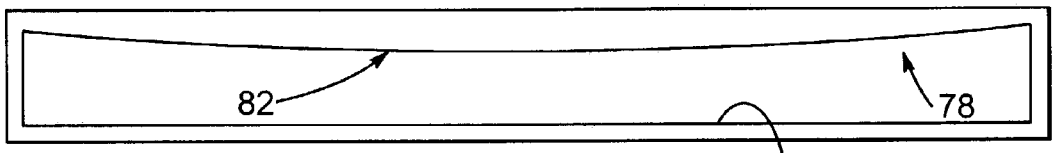
FIG. 8 is a diagrammatical view of a still further embodiment of an aperture configured according to the invention; and, FIG. 9 is a diagrammatical view of another aperture configured according to the invention.

Referring now to FIG. 8, a forward edge 78 of an aperture 80 is seen to be formed arcuately at 82, the edge 78 extending into the aperture 80 to provide the advantages herein described. The inverse shape of the edge 78 also functions to produce the performance described herein.

Figure 9:
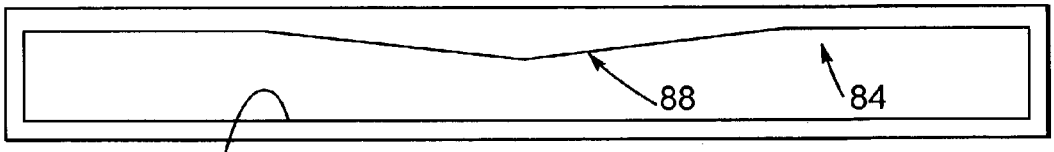

Now considering FIG. 9, it is to be understood that an intrusion into an aperture similar to the aperture 36 shown in FIG. 4 is caused to occur essentially at central portions of an aperture, a forward edge 84 of an aperture 86 as seen in FIG. 9 being formed along central portions thereof as a wedge 88, the wedge 88 extending from portions of the edge 84 near central portions thereof rather than tapering from ends thereof as occurs with the wedge 48 of the forward edge 40 shown in FIGS. 1 through 4. Intrusions into apertures of luminaires as contemplated by the invention can thus be seen to be most efficiently provided along centrally disposed portions of forward edges of said apertures whether such intrusions take the form of wedges, teeth, arcuate elements or the like. The inverse shape of the edge 84 also functions to produce the performance described herein.

The intrusions into the apertures of luminaires as configured according to the invention are particularly seen to accommodate variations in luminance in lamping and inconsistencies in reflector structures such as are typically produced by extrusion processes. The improvements so provided are explicitly shown in the several embodiments particularly described. However, it is to be understood that the invention can be configured other than as is explicitly described herein, the scope of the invention being defined by the recitations of the appended claims.

What is claimed is:

1. Apparatus for directing light onto a surface located in proximity to the apparatus, comprising:

a housing;

a light source disposed within the housing, the housing defining an aperture through which light generated by the light source passes to the surface to be illuminated; and, means carried by the apparatus and altering the shape of the aperture along an edge thereof nearmost the surface to be illuminated for producing a transition in imaging of luminance changes on the surface to produce a more visually smooth distribution of light on the surface.

2. The apparatus of claim 1 wherein the light source comprises an elongated tubular lamp.

3. The apparatus of claim 2 wherein the lamp is a fluorescent lamp.

4. The apparatus of claim 3 wherein the lamp is a T5 lamp.

5. The apparatus of claim 1 and further comprising means disposed within the housing for reflecting portions of the light generated by the lamp through the aperture.

6. The apparatus of claim 5 wherein reflective surfaces of the reflecting means are formed of highly specular material.

7. The apparatus of claim 1 wherein the apparatus comprises a small aperture luminaire.

8. The apparatus of claim 1 wherein the aperture is elongated and dimensioned with the edge being parallel to a longitudinal axis of the aperture, side edges of the aperture perpendicular to said edge being of lesser length than said edge.

9. The apparatus of claim 1 wherein the transition providing means comprises a wedge tapering from end portions of the aperture inwardly of said aperture with an apexal portion of the wedge extending into the aperture centrally of said edge.

10. The apparatus of claim 1 wherein the transition providing means comprises a wedge tapering from respective portions of the edge in proximity to central portions of the edge inwardly of said aperture with an apexal portion of the wedge extending into the aperture centrally of said edge.

11. The apparatus of claim 1 wherein the transition providing means comprises a wedge-shaped indentation tapering from end portions of the aperture outwardly of said aperture with an apexal portion of the indentation extending outwardly of said aperture centrally of said edge.

12. The apparatus of claim 1 wherein the transition providing means comprises at least one intrusion extending from the edge into the aperture from said edge.

13. The apparatus of claim 1 wherein the transition providing means comprises a non-linear edge.

14. The apparatus of claim 1 wherein the transition providing means comprises at least portions of the edge extending into the aperture and being non-linear with other portions of the edge.

15. The apparatus of claim 1 wherein the transition providing means comprises an arcuate protrusion extending into the aperture from the edge.

16. The apparatus of claim 1 wherein the transition providing means comprises sinusoidal protrusions extending into the aperture from the edge.

17. A small aperture luminaire having a housing defining an aperture, a light source disposed within the housing for generating light, the light passing through the aperture onto a surface for illumination of said surface, the aperture being substantially elongated and being defined at least partially by a forward edge disposed nearmost the surface, the forward edge being non-linear with at least a portion of the edge extending into the aperture.

18. The luminaire of claim 17 wherein the light source comprises an elongated fluorescent lamp having a longitudinal axis parallel to a longitudinal axis of the aperture.

19. The luminaire of claim 17 wherein the luminaire is mounted to a ceiling and the surface to be illuminated is oriented vertically relative to the ceiling, light from the light source acting to wash the vertical surface.

20. The luminaire of claim 17 and further comprising a reflector disposed within the housing for directing light image thereon from the lamp onto the surface, the reflector having highly specular reflective surfaces.

21. The apparatus of claim 1 wherein the aperture has length-wise dimensions relative to width-wise dimensions of a ratio of approximately 8 to 1 or greater.

22. The apparatus of claim 21 wherein the ratio is approximately 16 to 1.

23. The apparatus of claim 17 wherein the aperture has length-wise dimensions relative to width-wise dimensions of a ratio of approximately 8 to 1 or greater.

24. The apparatus of claim 23 wherein the ratio is approximately 16 to 1.

25. A method for directing light onto a surface from a luminaire located in proximity to the surface, the luminaire having a housing and a light source disposed within the housing, the housing defining an aperture through which light generated by the light source passes to the surface to be illuminated, comprising the steps of:

altering the shape of the aperture along an edge thereof nearmost the surface to be illuminated to produce a transition in imaging of luminance changes on the surface; and, passing light from the light source through the aperture so altered to produce a more visually smooth distribution of light on the surface.

26. The method of claim 25 wherein the altering step comprises the step of shaping the edge of the aperture nearmost the surface to be illuminated in a taper extending from end portions of the edge of the aperture inwardly of said aperture to form a wedge thereon, an apexal portion of the wedge extending into the aperture centrally of the edge.

27. The method of claim 25 wherein the light source comprises an elongated tubular lamp.

28. The method of claim 27 wherein the lamp is a fluorescent lamp.

29. The method of claim 28 wherein the lamp is a T5 lamp.

30. The method of claim 25 wherein the housing further has a reflector carried thereby for directing at least some of the light emanating from the light source through the aperture.

31. The method of claim 30 wherein the reflector has reflective surfaces formed of highly specular material.

32. The method of claim 25 wherein the luminaire comprises a small aperture luminaire.

33. The method of claim 25 wherein the aperture is elongated and dimensioned with the edge being parallel to a longitudinal axis of the aperture, side edges of the aperture perpendicular to said edge being of lesser length than said edge.

34. The method of claim 25 wherein the shape of the edge is altered into the shape of a wedge tapering from end portions of the aperture inwardly of said aperture with an apexal portion of the wedge extending into the aperture centrally of said edge.

35. The method of claim 33 wherein the shape of the edge is altered into the shape of a wedge tapering from end portions of the aperture inwardly of said aperture with an apexal portion of the wedge extending into the aperture centrally of said edge.

36. Apparatus for directing light onto a surface located in proximity to the apparatus, comprising:

a housing;

a light source disposed within the housing, the housing defining an aperture through which light generated by the light source passes to the surface to be illuminated; and, means carried by the apparatus and altering the shape of the aperture along an edge thereof nearmost the surface to be illuminated for producing a transition in imaging of luminance changes on the surface to produce a more visually smooth distribution of light on the surface, the transition providing means comprising a wedge tapering from end portions of the aperture inwardly of said aperture with an apexal portion of the wedge extending into the aperture centrally of said edge.

37. The apparatus of claim 36 wherein the light source comprises an elongated tubular lamp.

38. The apparatus of claim 37 wherein the lamp is a fluorescent lamp.

39. The apparatus of claim 38 wherein the lamp is a T5 lamp.

40. The apparatus of claim 36 and further comprising means disposed within the housing for reflecting portions of the light generated by the lamp through the aperture.

41. The apparatus of claim 40 wherein reflective surfaces of the reflecting means are formed of highly specular material.

42. The apparatus of claim 36 wherein the apparatus comprises a small aperture luminaire.

43. The apparatus of claim 36 wherein the aperture is elongated and dimensioned with the edge being parallel to a longitudinal axis of the aperture, side edges of the aperture perpendicular to said edge being of lesser length than said edge.

44. The apparatus of claim 36 wherein the transition providing means comprises more than one intrusion extending from the edge into the aperture from said edge.

45. The apparatus of claim 36 wherein the aperture has length-wise dimensions relative to width-wise dimensions of a ratio of approximately 8 to 1 or greater.

46. The apparatus of claim 45 wherein the ratio is approximately 16 to 1.

47. A small aperture luminaire having a housing defining an aperture, a light source disposed within the housing for generating light, the light passing through the aperture onto a surface for illumination of said surface, the aperture being substantially elongated and being defined at least partially by a forward edge disposed nearmost the surface, the forward edge being non-linear with at least a portion of the edge extending into the aperture, the non-linear forward edge comprising a wedge with an apexal portion extending into the aperture centrally of said edge.

48. The luminaire of claim 47 wherein the light source comprises an elongated fluorescent lamp having a longitudinal axis parallel to a longitudinal axis of the aperture.

49. The luminaire of claim 47 wherein the luminaire is mounted to a ceiling and the surface to be illuminated is oriented vertically relative to the ceiling, light from the light source acting to wash the vertical surface.

50. The luminaire of claim 47 and further comprising a reflector disposed within the housing for directing light image thereon from the lamp onto the surface, the reflector having highly specular reflective surfaces.

51. The apparatus of claim 47 wherein the aperture has length-wise dimensions relative to width-wise dimensions of a ratio of approximately 8 to 1 or greater.

52. The apparatus of claim 51 wherein the ratio is approximately 16 to 1.

53. Apparatus for directing light onto a surface located in proximity to the apparatus, comprising:

a housing;

a light source disposed within the housing, the housing defining an aperture through which light generated by the light source passes to the surface to be illuminated; and, means carried by the apparatus and altering the shape of the aperture along an edge thereof nearmost the surface to be illuminated for producing a transition in imaging of luminance changes on the surface to produce a more visually smooth distribution of light on the surface, the transition providing means comprising a wedge tapering from respective portions of the edge in proximity to central portions of the edge inwardly of said aperture with an apexal portion of the wedge extending into the aperture centrally of said edge.

54. Apparatus for directing light onto a surface located in proximity to the apparatus, comprising:

a housing;

a light source disposed within the housing, the housing defining an aperture through which light generated by the light source passes to the surface to be illuminated; and, means carried by the apparatus and altering the shape of the aperture along an edge thereof nearmost the surface to be illuminated for producing a transition in imaging of luminance changes on the surface to produce a more visually smooth distribution of light on the surface, the transition providing means comprising a wedge-shaped indentation tapering from end portions of the aperture outwardly of said aperture with an apexal portion of the indentation extending outwardly of said aperture centrally of said edge.

* * * * *